US012187572B2

(12) United States Patent
Yang et al.

(10) Patent No.: US 12,187,572 B2
(45) Date of Patent: Jan. 7, 2025

(54) BINDING DEVICE

(71) Applicants: Tyco Electronics (Shanghai) Co. Ltd, Shanghai (CN); TE Connectivity Services GmbH, Schaffhausen (CH)

(72) Inventors: An (Joshua) Yang, Shanghai (CN); Lvhai (Samuel) Hu, Shanghai (CN); Roberto Francisco-Yi Lu, Bellevue, WA (US)

(73) Assignees: Tyco Electronics (Shanghai) Co., Ltd., Shanghai (CN); TE Connectivity Solutions GmbH, Schaffhausen (CH)

( * ) Notice: Subject to any disclaimer, the term of this patent is extended or adjusted under 35 U.S.C. 154(b) by 252 days.

(21) Appl. No.: 17/829,547

(22) Filed: Jun. 1, 2022

(65) Prior Publication Data

US 2022/0388807 A1 Dec. 8, 2022

(30) Foreign Application Priority Data

Jun. 2, 2021 (CN) ..... 202110614715.6

(51) Int. Cl.
*B65H 75/28* (2006.01)
*B65H 19/29* (2006.01)
(Continued)

(52) U.S. Cl.
CPC ..... *B65H 75/28* (2013.01); *B65H 19/29* (2013.01); *B65H 35/0006* (2013.01);
(Continued)

(58) Field of Classification Search
CPC ..... B65H 35/00; B65H 35/0006; B65H 35/0033; B65H 35/0073; B65H 35/008; B65H 35/0086; B65H 35/002; B65H 35/0026; B65H 35/04; B65H 35/06; B65H 19/29; B65H 75/28; B65H 2301/414433; B65H 2301/414422; B65H 2301/377; B65H 2301/43823
See application file for complete search history.

(56) References Cited

U.S. PATENT DOCUMENTS 3,871,940 A * 3/1975 Antonioni ..... B05C 9/10 156/577
4,651,910 A * 3/1987 DeGroot ..... B65H 35/0026 225/48
(Continued)

FOREIGN PATENT DOCUMENTS

CH 658849 A5 * 12/1986 ..... B65H 37/005
CN 106743944 A * 5/2017 ..... B65H 19/29
(Continued)

*Primary Examiner* — Michael R Mansen
*Assistant Examiner* — Raveen J Dias
(74) *Attorney, Agent, or Firm* — Barley Snyder

(57) ABSTRACT

A binding device binds a material strip reel on which a contact material strip is wound. The binding device includes a frame, a tape supply unit installed on the frame for supplying an adhesive tape, a first damper and a second damper mounted on the frame for clamping the adhesive tape, and a first roller and a second roller installed on the frame. The first roller and the second roller push and paste the adhesive tape between the first damper and the second damper onto a pair of opposite sides of the material strip reel.

20 Claims, 8 Drawing Sheets

(51) Int. Cl.
*B65H 35/00* (2006.01)
*B65H 54/02* (2006.01)

(52) U.S. Cl.
CPC ..... *B65H 35/0086* (2013.01); *B65H 54/02* (2013.01); *B65H 2301/414433* (2013.01); *B65H 2301/43823* (2013.01); *B65H 2701/377* (2013.01)

(56) References Cited

U.S. PATENT DOCUMENTS 5,269,871 A * 12/1993 Longworth ..... B65H 35/0033 156/577
5,419,511 A * 5/1995 Takahashi ..... B65H 19/286 242/532.3
5,620,544 A * 4/1997 Cram ..... B65H 37/04 242/541.2
5,641,378 A * 6/1997 Luhman ..... B65H 37/005 156/577
5,885,391 A * 3/1999 Cram ..... B65H 19/2207 156/519
6,478,068 B1 * 11/2002 Brown ..... B65H 35/0033 156/577
6,617,007 B1 * 9/2003 Cram ..... B65H 37/04 242/526
8,176,959 B2 * 5/2012 Lam ..... B65H 35/0013 156/468
10,532,842 B1 * 1/2020 Zoss ..... B65H 35/008
10,633,209 B2 * 4/2020 Caye ..... B65H 35/0033
11,247,865 B1 * 2/2022 Ellis ..... B65H 37/007
11,629,024 B1 * 4/2023 Bizer ..... B65H 35/0086 156/523
11,884,502 B2 * 1/2024 Ellis ..... B65H 35/0033
11,932,504 B2 * 3/2024 Bizer ..... B65H 19/29
2004/0200559 A1 * 10/2004 Richards ..... B65H 35/0033 156/574
2011/0057010 A1 * 3/2011 Jonker ..... B65H 35/0033 225/39
2011/0271811 A1 * 11/2011 Sheffield ..... A61J 7/0084 83/649
2012/0097334 A1 * 4/2012 Lam ..... B65H 45/22 156/350
2014/0311677 A1 * 10/2014 Huang ..... B29C 65/00 156/510
2016/0101960 A1 * 4/2016 Lam ..... B65H 35/0033 156/577
2016/0244290 A1 * 8/2016 De Marco ..... B65H 19/1852
2017/0278597 A1 * 9/2017 Houser ..... H02G 3/32
2018/0273335 A1 * 9/2018 Fox ..... B31B 70/81
2018/0346276 A1 * 12/2018 Hivatal ..... B65H 26/00
2022/0073306 A1 * 3/2022 Ellis ..... B65H 37/007
2022/0127100 A1 * 4/2022 Ellis ..... B65H 37/007
2022/0396449 A1 * 12/2022 Russell ..... B65H 35/0033
2023/0182945 A1 * 6/2023 Monti ..... B65B 61/06 156/468
2023/0322515 A1 * 10/2023 Bizer ..... B65H 19/29 156/523

FOREIGN PATENT DOCUMENTS

DE 102013019696 B4 * 9/2016 ..... B65B 63/04
DE 102015006494 B4 * 11/2017 ..... B65H 19/29

* cited by examiner

BINDING DEVICE

CROSS-REFERENCE TO RELATED APPLICATION

This application claims the benefit of the filing date under 35 U.S.C. § 119(a)-(d) of Chinese Patent Application No. 202110614715.6, filed on Jun. 2, 2021.

FIELD OF THE INVENTION

The present invention relates to a binding device and, more particularly, relates to a binding device for binding a material strip reel on which a contact material strip is wound.

BACKGROUND

In the prior art, to improve the manufacturing efficiency of a contact, a stamped contact material strip is usually used to manufacture the contact. To protect the contact material strip from damage during transportation, the contact material strip is usually wound in a circumferential groove of a material strip reel, and adhesive tape is pasted at multiple positions on the material strip reel to keep the contact material strip in the circumferential groove of the material strip reel and prevent the contact material strip from being released from the material strip reel.

In the prior art, the adhesive tape is usually pasted to the material strip reel manually. This manual tape pasting method has very low efficiency and high cost.

SUMMARY

A binding device binds a material strip reel on which a contact material strip is wound. The binding device includes a frame, a tape supply unit installed on the frame for supplying an adhesive tape, a first damper and a second damper mounted on the frame for clamping the adhesive tape, and a first roller and a second roller installed on the frame. The first roller and the second roller push and paste the adhesive tape between the first damper and the second damper onto a pair of opposite sides of the material strip reel.

BRIEF DESCRIPTION OF THE DRAWINGS

The invention will now be described by way of example with reference to the accompanying Figures, of which.

DETAILED DESCRIPTION OF THE EMBODIMENTS

Figure 1:
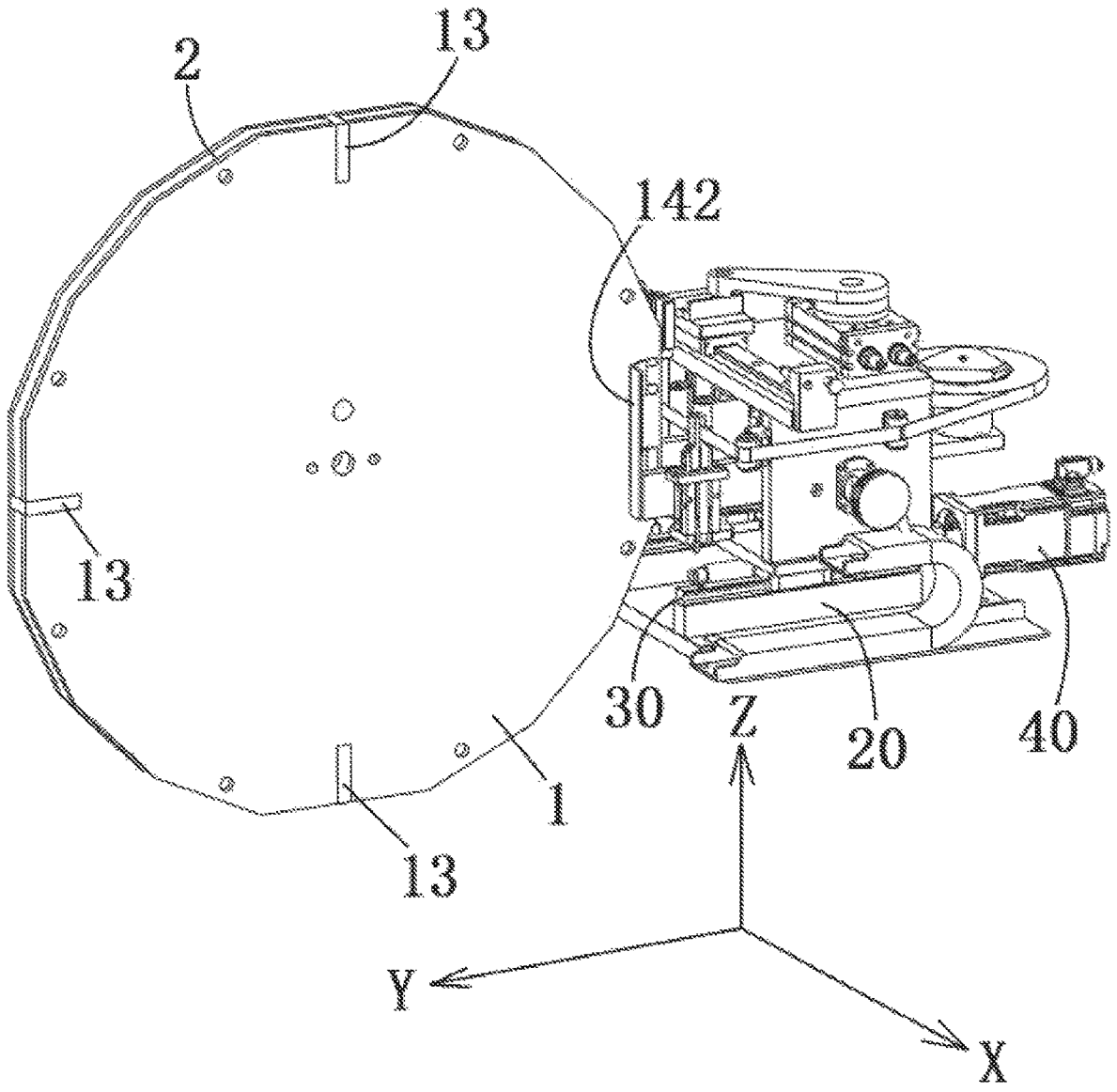
FIG. 1 is a perspective diagram of a binding device according to an embodiment with a material strip reel.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth to provide a thorough understanding of the disclosed embodiments. It will be apparent, however, that one or more embodiments may be practiced without these specific details. In other instances, well-known structures and devices are schematically shown to simplify the drawing.

Figure 2:
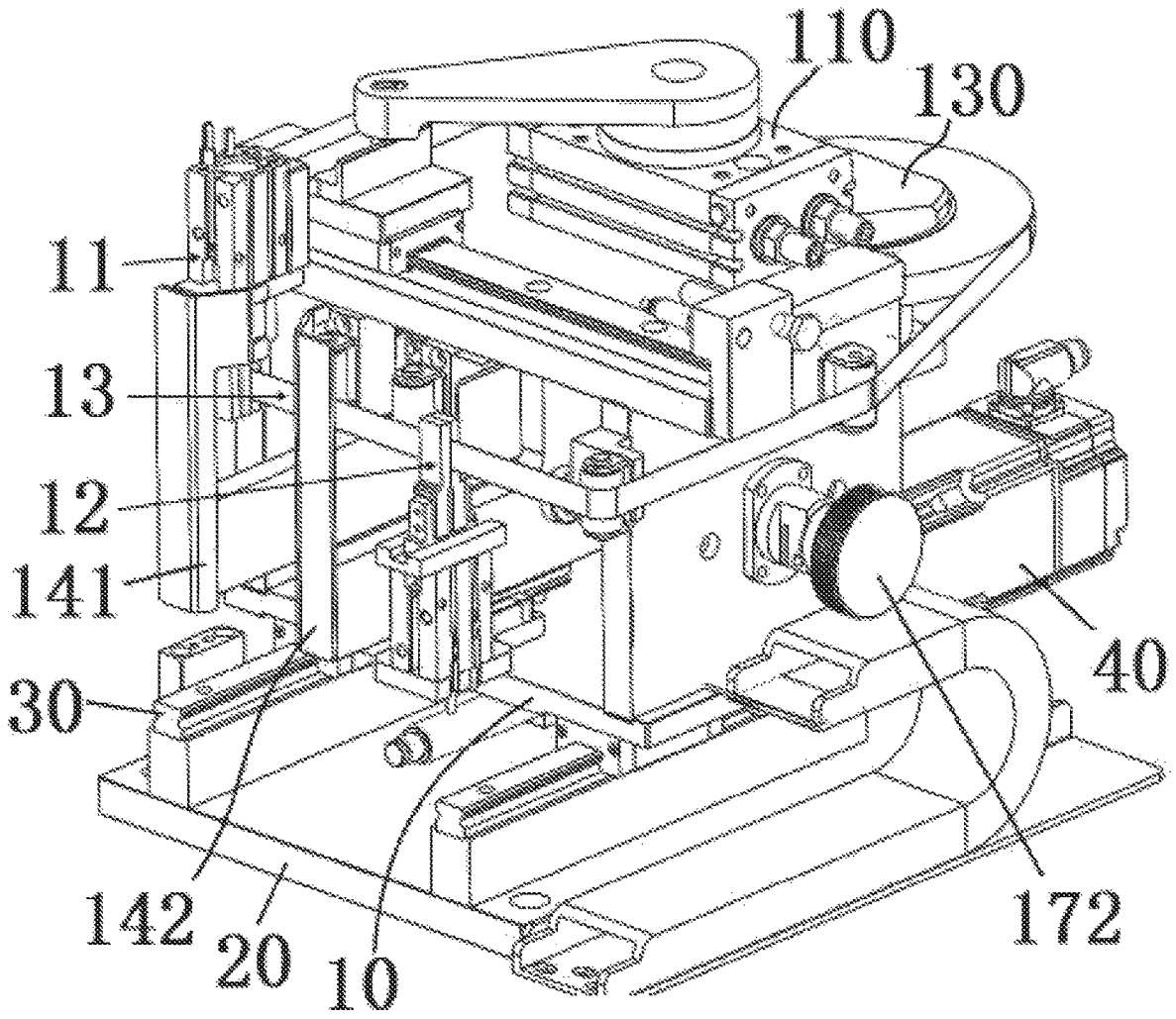
FIG. 2 is a front perspective diagram of the binding device.
Figure 5:
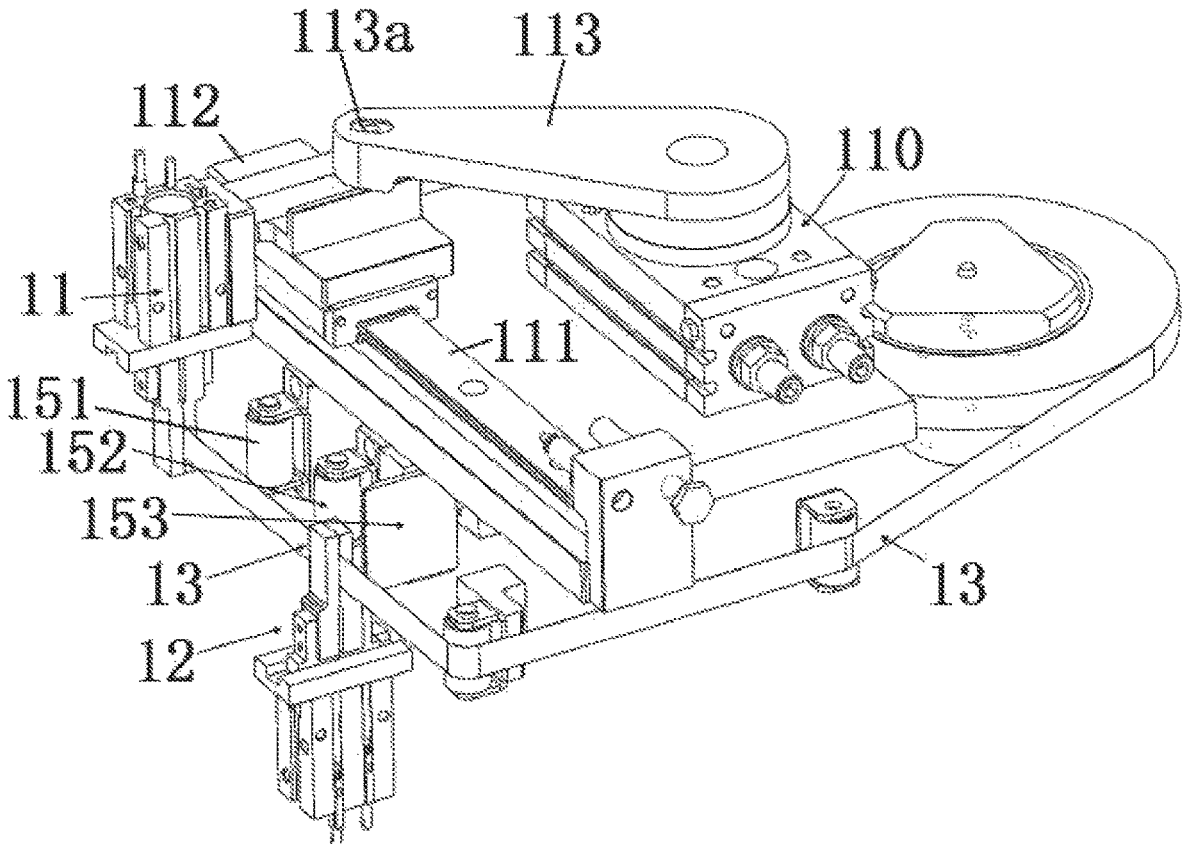
FIG. 5 is a perspective view of the binding device without a frame and a base.

FIG. 1 shows a three-dimensional schematic diagram of a binding device according to an exemplary embodiment of the present invention, in which a material strip reel 1 is shown. FIG. 2 shows a three-dimensional schematic diagram of the binding device shown in FIG. 1 when viewed from the front side. FIG. 5 shows a three-dimensional schematic diagram of the binding device shown in FIG. 2, in which the frame 10 and the base 20 are not shown.

As shown in FIGS. 1-2 and FIG. 5, in the illustrated embodiment, the binding device is used to paste adhesive tape 13 on a plurality of positions of the material strip reel 1 to hold the contact material strip wound on the material strip reel 1 in a circumferential groove 2 of the material strip reel 1 and prevent the wound contact material strip from loosening and releasing from the material strip reel 1.

As shown in FIGS. 1-2 and 5, the binding device includes a frame 10, a tape supply unit, a first damper 11, a second damper 12, a first roller 151 and a second roller 152. The tape supply unit is installed on the frame 10 for supplying an adhesive tape 13. The first damper 11 and the second damper 12 are mounted on the frame 10 for clamping the supplied adhesive tape 13. The first roller 151 and the second roller 152 are mounted on the frame 10 for pushing and pasting the adhesive tape 13 located between the first and second dampers 11 and 12 onto both sides of the material strip reel 1.

In the illustrated embodiment, the adhesive tape 13 may be a paper tape with glue on one side and no glue on the other side. The material strip reel 1 is located on the side with glue of the adhesive tape 13, and the first roller 151 and the second roller 152 are located on the other side without glue of the adhesive tape 13.

Figure 3:
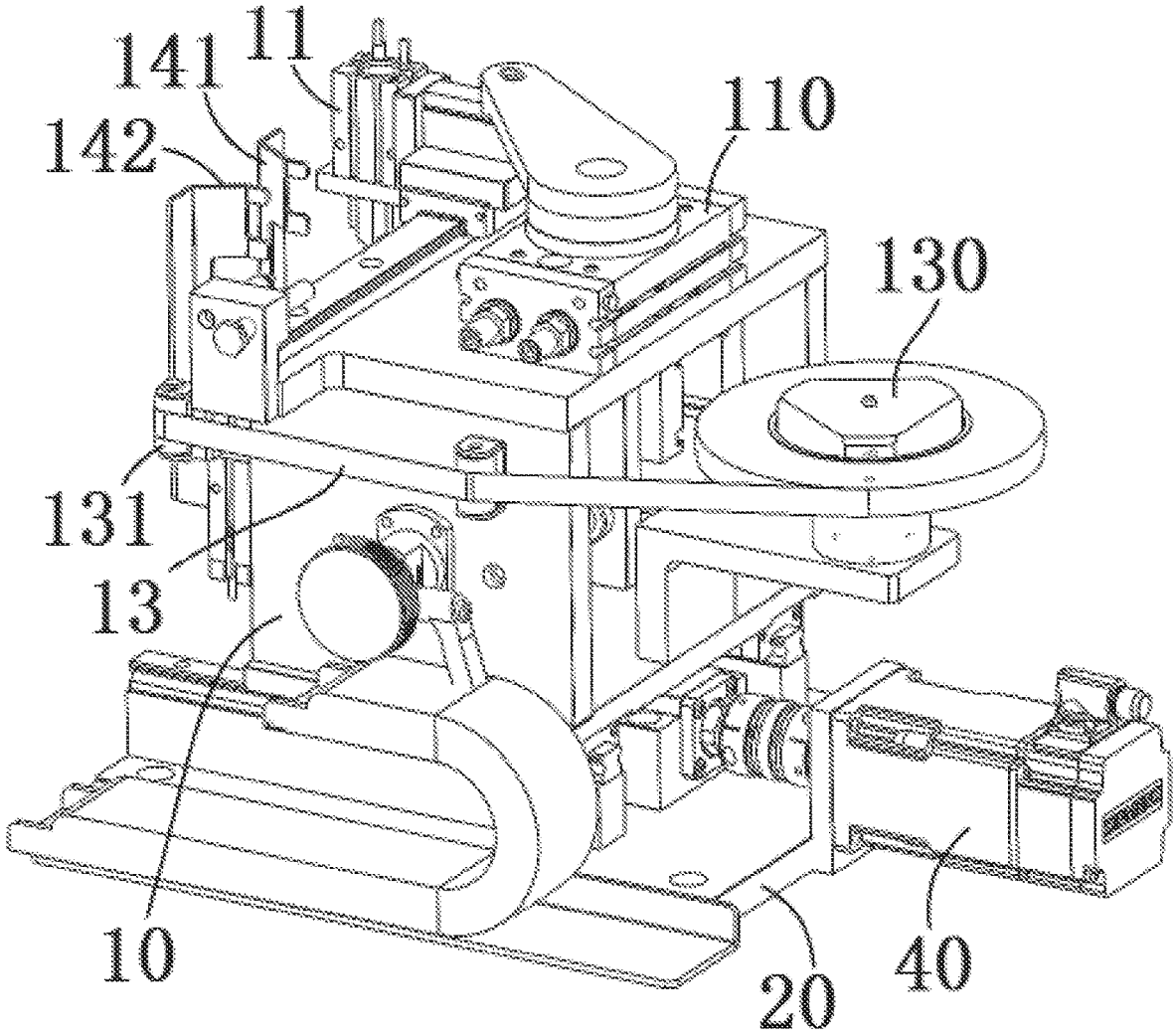
FIG. 3 is a rear perspective diagram of the binding device.
Figure 4:
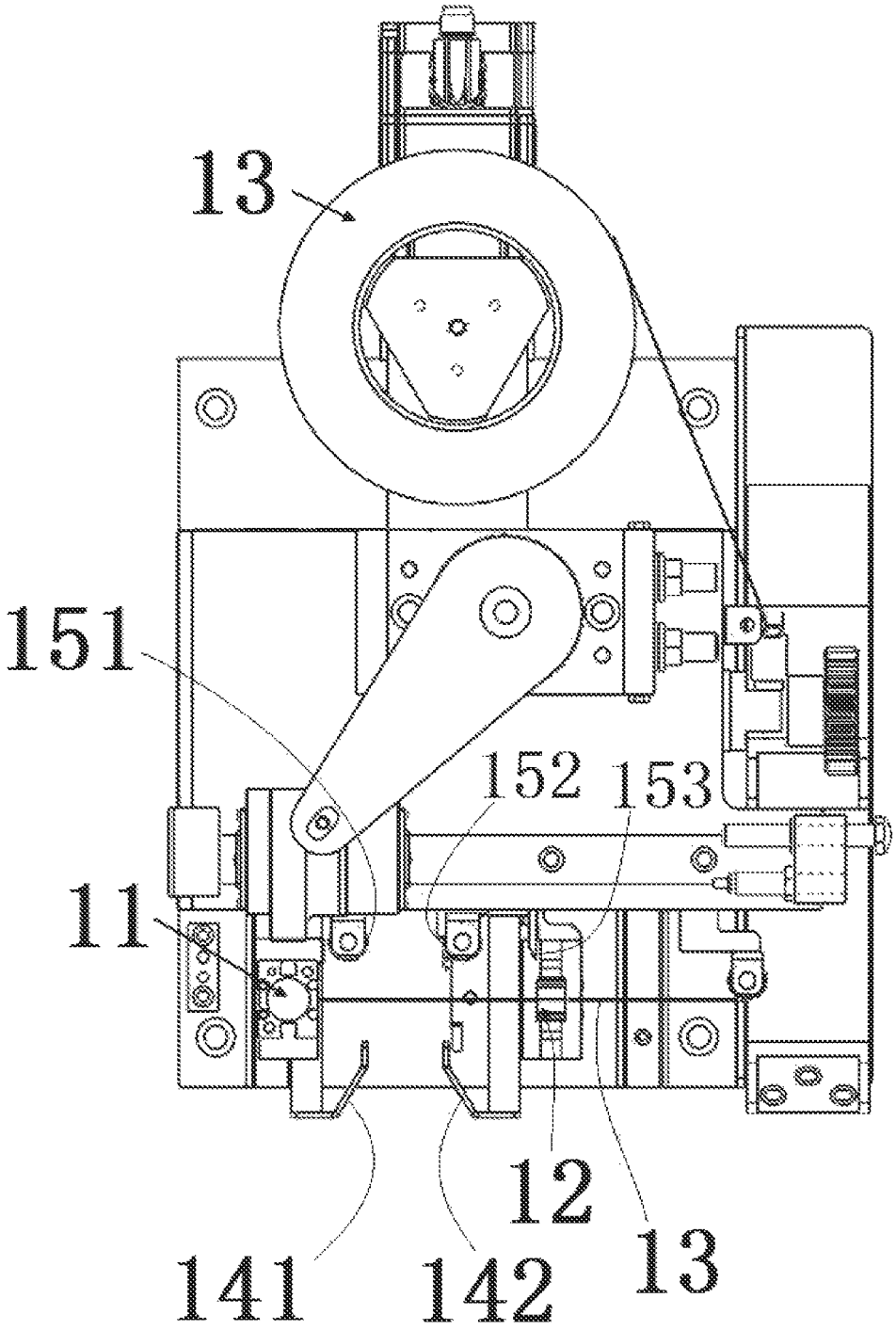
FIG. 4 is a plan view of the binding device.

FIG. 3 shows a three-dimensional schematic diagram of the binding device shown in FIG. 1 when viewed from the rear; FIG. 4 shows a schematic plan view of the binding device shown in FIG. 1 when viewed from the top side.

As shown in FIG. 5, in the illustrated embodiment, the first and second rollers 151 and 152 are arranged side by side in the first horizontal direction X. The material strip reel 1 is clamped between the first and second rollers 151 and 152 so that the first and second rollers 151 and 152 can roll simultaneously on both sides of the material strip reel 1. In this way, the adhesive tape 13 can be pushed and pasted on both sides of the material strip reel 1 at the same time by the first and second rollers 151 and 152. In the illustrated embodiment, the adhesive tape 13 pasted on the material strip reel 1 crosses the circumferential groove 2 on the material strip reel 1, so that the contact material strip 1 can be maintained in the circumferential groove 2 of the material strip reel 1.

As shown in FIGS. 4 and 5, in the illustrated embodiment, the binding device also includes a cutter 153 installed on the frame 10 for cutting the adhesive tape 13, so that the adhesive tape 13 pasted on the material strip reel 1 is separated from the tape supply unit and is left on the material strip reel 1.

Figure 7:
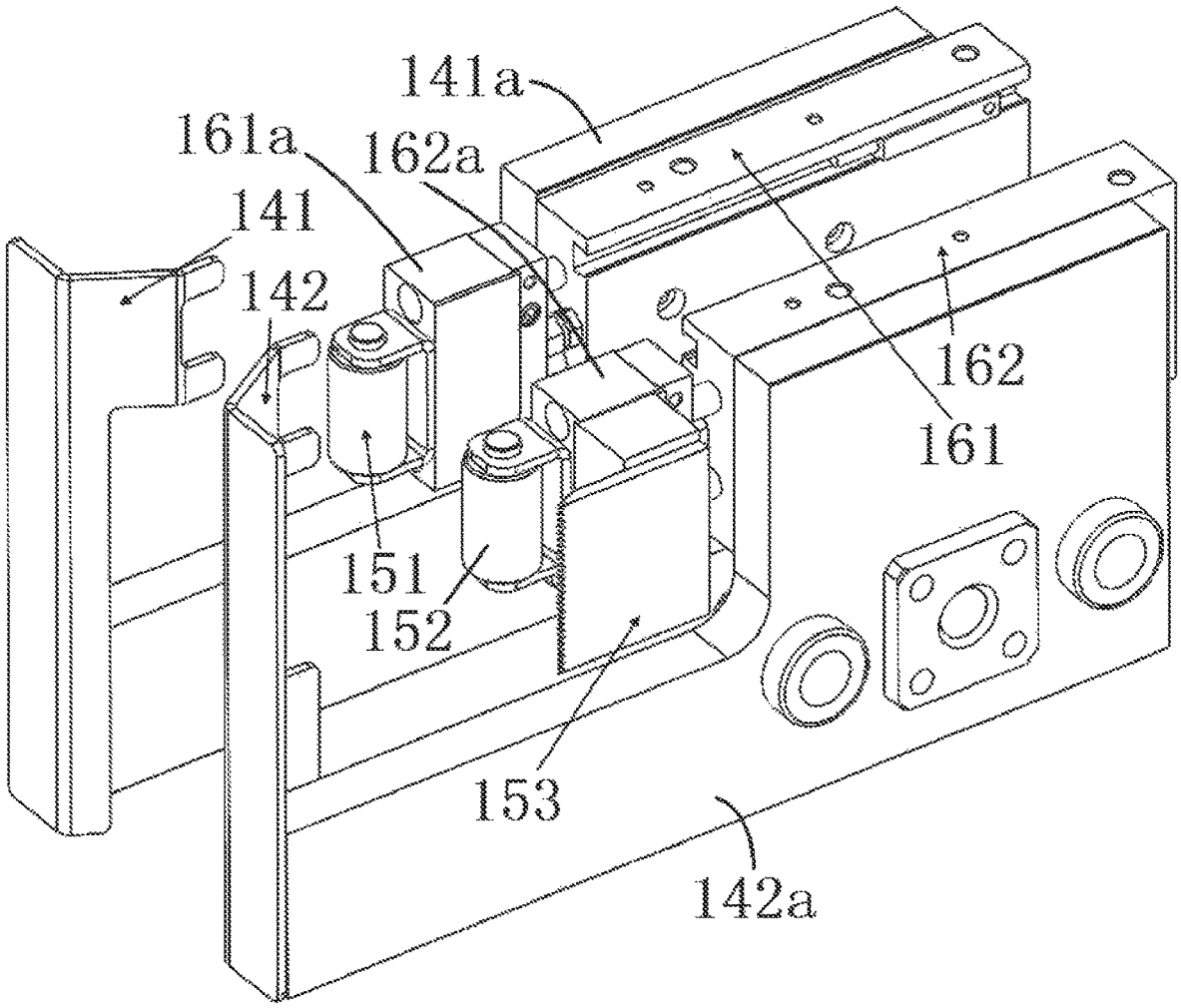
FIG. 7 is a perspective view of a first roller, a second roller, a first guide plate, a second guide plate, and a cutter of the binding device.

FIG. 7 shows a three-dimensional schematic diagram of the first roller 151, the second roller 152, the first guide plate 141, the second guide plate 142 and the cutter 153 of the binding device shown in FIG. 2.

As shown in FIG. 7, in the illustrated embodiment, the binding device also includes a driving device 161 and 162. The driving device 161 and 162 is installed on the frame 10 and is used to drive the first roller 151, the second roller 152 and the cutter 153 to move synchronously along the second horizontal direction Y perpendicular to the first horizontal direction X.

The driving device 161 and 162, as shown in FIG. 7, includes a first cylinder 161, a first seat 161*a*, a second cylinder 162, and a second seat 162*a*. The first cylinder 161 is a linear cylinder and is mounted on the frame 10. The first seat 161*a* is connected to the piston rod of the first cylinder 161 so that it can move back and forth along the second horizontal direction Y with the piston rod of the first cylinder 161. The second cylinder 162 is a linear cylinder and is mounted on the frame 10. The second seat 162*a* is connected to the piston rod of the second cylinder 162 so that it can move back and forth along the second horizontal direction Y with the piston rod of the second cylinder 162.

As shown in FIG. 7, in the illustrated embodiment, the first roller 151 is rotatably mounted on the first seat 161*a*, the second roller 152 is rotatably mounted on the second seat 162*a*, and the cutter 153 is fixed to the second seat 162*a*.

Figure 6:
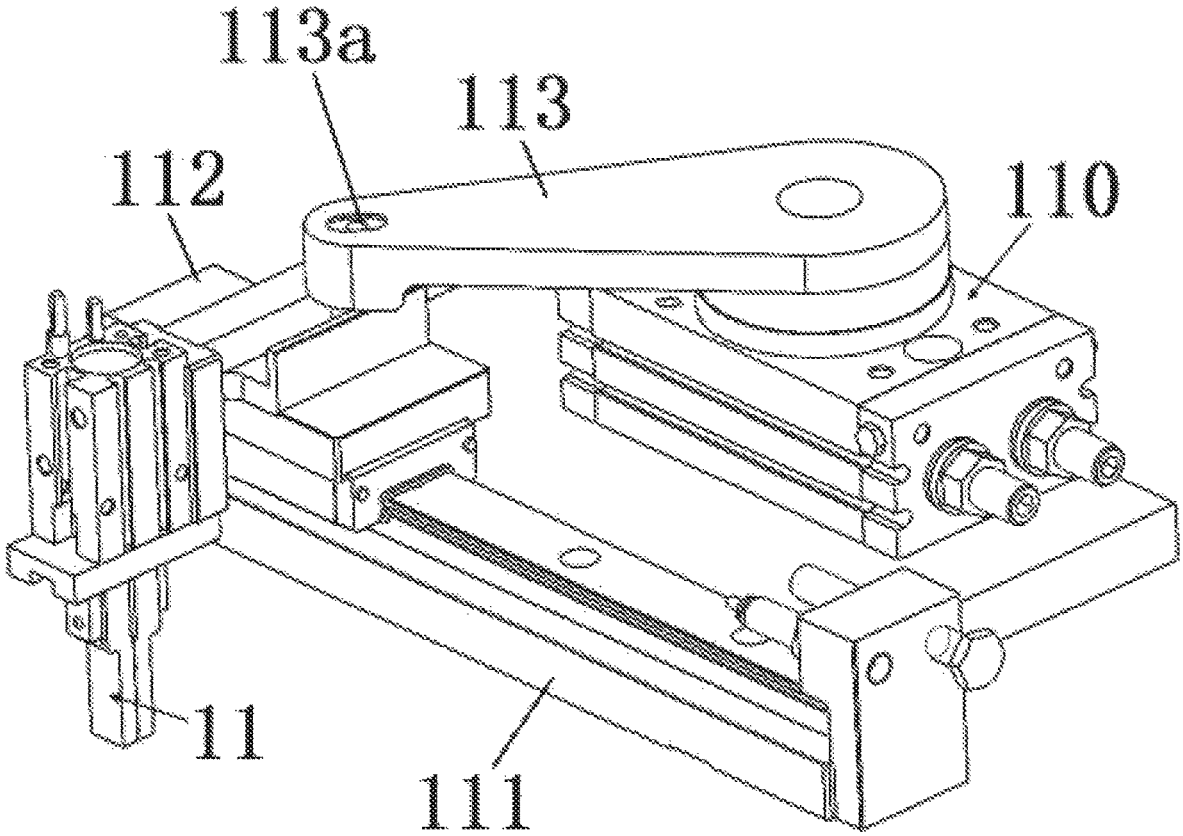
FIG. 6 is a perspective view of a first damper and a driving mechanism of the binding device.

FIG. 6 shows a three-dimensional schematic diagram of the first damper 11 and the driving mechanism of the binding device shown in FIG. 2.

The first damper 11 is movably mounted on the frame 10, and the second clamper 12 is fixedly mounted on the frame 10. The first damper 11 can move in the first horizontal direction X relative to the second damper 12 between a first position adjacent to the second damper 12 and a second position distanced from the second damper 12 by a predetermined distance.

As shown in FIGS. 5 and 6, the binding device also includes a slide rail 111 and a slider 112. The slide rail 111 extends along the first horizontal direction X and is mounted on the frame 10. The slider 112 is slidably mounted on the slide rail 111. The first damper 11 is fixed to the slider 112 so that it can move between the first position and the second position along the slide rail 111 with the slider 112.

As shown in FIGS. 5 and 6, the binding device also includes a driving mechanism 110 and 113. The driving mechanism 110 and 113 is installed on the frame 10 to drive the first clamper 11 to move between the first position and the second position along the first horizontal direction X. In the illustrated embodiment, the driving mechanism 110 and 113 includes a rotating cylinder 110 and a connecting arm 113. One end of the connecting arm 113 is connected to the output rotation shaft of the rotating cylinder 110, and the other end of the connecting arm 113 is slidably connected to the slider 112 via a member 113*a*. The other end of the connecting arm 113 may slide in a second horizontal direction Y perpendicular to the first horizontal direction X with respect to the slider 112.

Figure 8:
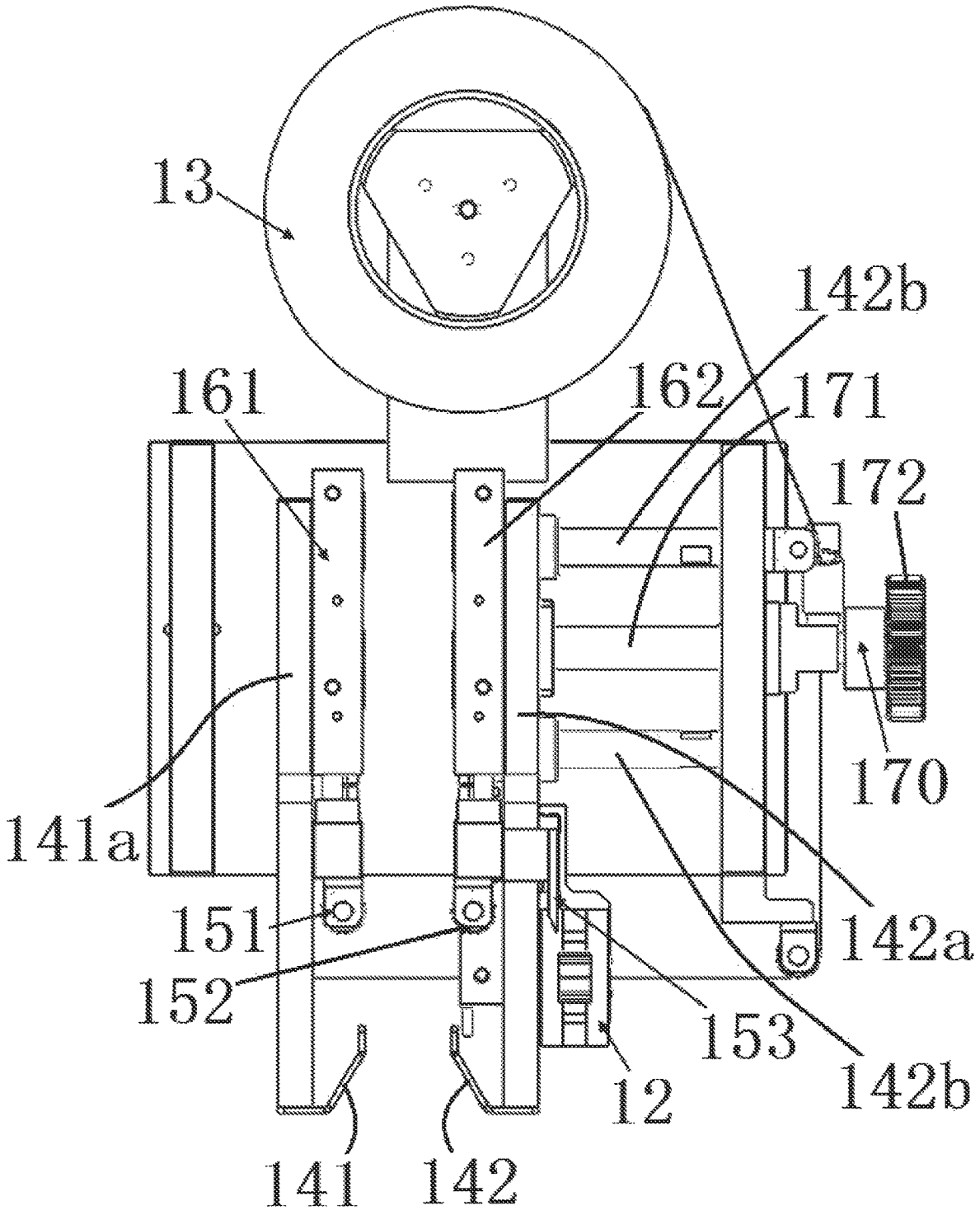
FIG. 8 is a schematic diagram of a spacing adjustment mechanism for driving the movement of the second roller, the second guide plate, and the cutter.

As shown in FIGS. 7 and 8, the binding device also includes a first guide plate 141 and a second guide plate 142 mounted on the frame 10. The first and second guide plates 141 and 142 define a V-shaped guide inlet to guide the material strip reel 1 into a gap between the first and second rollers 151 and 152.

In the shown embodiment, the first guide plate 141 and the first cylinder 161 are fixedly mounted on the frame 10, and the second guide plate 142 and the second cylinder 162 are movably mounted on the frame 10. The second guide plate 142 and the second cylinder 162 can move together in the first horizontal direction X to adjust the spacing between the first and second rollers 151 and 152 and the spacing between the first and second guide plates 141 and 142 at the same time. In this way, the binding device can be suitable for material strip reel 1 with different thickness.

FIG. 8 shows a schematic diagram of a spacing adjustment mechanism for driving the movement of the second roller 152, the second guide plate 142 and the cutter 153 shown in FIG. 7.

As shown in FIGS. 7 and 8, the binding device also includes a fixing plate 141*a* fixed to the frame 10. The first guide plate 141 and the first cylinder 161 are fixed to the fixing plate 141*a*.

As shown in FIG. 8, the binding device also includes a pair of sliding rods 142*b* and a sliding plate 142*a*. The pair of sliding rods 142*b* extend along the first horizontal direction X and are mounted on the frame 10. The sliding plate 142*a* is slidably mounted on the pair of sliding rods 142*b*. The second guide plate 142 and the second cylinder 162 are fixed to the sliding plate 142*a* so that they can slide along the sliding rod 142*b* with the sliding plate 142*a*.

In the shown embodiment, the binding device also includes a spacing adjustment mechanism 170 installed on the frame 10, which is used to drive the sliding plate 142*a* to slide along the sliding rod 142*b* to adjust the spacing between the first and second rollers 151 and 152 and the spacing between the first and second guide plates 141 and 142.

As shown in FIG. 8, the spacing adjustment mechanism 170 includes a lead screw 171 and a knob 172. The lead screw 171 is rotatably mounted on the frame 10 and threaded with the sliding plate 142*a*. The knob 172 is connected to the end of the lead screw 171 to drive the lead screw 171 to rotate. When the knob 172 is turned, the sliding plate 142*a* can be driven to move along the first horizontal direction X by the lead screw 171, so that the spacing between the first and second rollers 141 and 142 and the spacing between the first and second guide plates 141 and 142 can be adjusted.

The tape supply unit includes a tape reel 130 and a plurality of guide rollers 131. The tape reel 130 is rotatably mounted on the frame 10, and the adhesive tape 13 is wound on it. In the illustrated embodiment, the tape reel 130 may rotate about an axis extending in a vertical direction Z (a direction perpendicular to the first horizontal direction X and the second horizontal direction Y). A plurality of guide rollers 131 are rotatably mounted on the frame 10 and can rotate around the vertical axis respectively. The adhesive tape 13 released from the tape reel 130 is guided along a predetermined path to the second damper 12 via the guide rollers 131.

As shown in FIGS. 1 and 2, the binding device also includes a base 20 and a pair of sliding guide rails 30. The pair of sliding guide rails 30 are mounted on the base 20 and extend along the first horizontal direction X. The frame 10 is slidably mounted on the pair of sliding guide rails 30 and can move back and forth along the pair of sliding guide rails 30. In this way, all components installed on the frame 10 can move forward and backward as a whole.

The binding device also includes a servo drive mechanism 40, shown in FIGS. 1 to 3, mounted on the base 20 for driving the frame 10 to move back and forth along the pair of sliding guide rails 30. In an exemplary embodiment of the present invention, the servo drive mechanism 40 may comprise a servo motor.

The working process of the binding device of the present invention will be described in detail below with reference to the accompanying drawings.

First, the second damper 12 clamps the supplied adhesive tape 13.

Then, the first damper 11 is moved to the first position close to the second damper 12 and clamps the end of the adhesive tape 13.

Then, the second damper 12 releases the adhesive tape 13.

Then, the first damper 11 is moved to the second position distanced from the second damper 12 by a predetermined distance to drag the end of the adhesive tape 13 to the second position, so that the adhesive tape 13 kept between the first damper 11 and the second damper 12 has a predetermined length.

Then, the servo drive mechanism 40 drives the frame 10 to move forward so that the material strip reel 1 is inserted into the guide inlet between the first guide plate 141 and the second guide plate 142.

Then, the first cylinder 161 and the second cylinder 162 drive the first roller 151 and the second roller 152 to move forward synchronously to push and paste the adhesive tape 13 kept between the first and second dampers 11 and 12 onto both sides of the material strip reel 1 through the first roller 151 and the second roller 152. In this step, the material strip reel 1 is clamped between the first roller 151 and the second roller 152, the first roller 151 and the second roller 152 roll on both sides of the material strip reel 1.

Then, the first damper 11 releases the adhesive tape 13 and the cutter 153 cuts off the adhesive tape 13 so that the adhesive tape 13 pasted on the material strip reel 1 is separated from the tape supply unit and is left on the material strip reel 1.

Finally, the servo drive mechanism 40 drives the frame 10 to move backward to its initial position, and the first cylinder 161 and the second cylinder 162 drive the first roller 151, the second roller 152 and the cutter 153 to move backward synchronously to their initial positions.

In the above exemplary embodiments according to the present invention, the binding device can automatically paste the adhesive tape 13 onto the material strip reel 1, improve the pasting efficiency of the adhesive tape 13 and reduce the cost.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A binding device for binding a material strip reel on which a contact material strip is wound, comprising:

a base;

a frame slidably installed on the base and movable relative to the base in a first horizontal direction;

a tape supply unit installed on the frame for supplying an adhesive tape;

a first clamper and a second clamper mounted on the frame for clamping the adhesive tape; and a first roller and a second roller installed on the frame for pushing and pasting the adhesive tape between the first clamper and the second clamper onto a pair of opposite sides of the material strip reel.

2. The binding device of claim 1, wherein the tape supply unit includes a tape reel rotatably mounted on the frame, the adhesive tape wound on the tape reel, and a guide roller rotatably mounted on the frame, the adhesive tape released from the tape reel is guided to the second clamper via the guide roller.

3. The binding device of claim 1, further comprising:

a sliding guide rail installed on the base, the frame slidably mounted on the sliding guide rail; and a servo drive mechanism installed on the base and configured to drive the frame to move back and forth along the sliding guide rail.

4. A binding device for binding a material strip reel on which a contact material strip is wound, comprising:

a frame;

a tape supply unit installed on the frame for supplying an adhesive tape;

a first clamper and a second clamper mounted on the frame for clamping the adhesive tape; and a first roller and a second roller installed on the frame for pushing and pasting the adhesive tape between the first clamper and the second clamper onto a pair of opposite sides of the material strip reel, the first roller and the second roller are arranged side by side in a first horizontal direction, the material strip reel is clamped between the first roller and the second roller to allow the first roller and the second roller to roll simultaneously on a first side of the material strip reel and a second side of the material strip reel, the first side and the second side facing in opposite axial directions of the material strip reel, and paste the adhesive tape on both the first and the second axially facing sides of the material strip reel at the same time and over a radially outward facing side of the material strip reel to retain the contact material strip on the material strip reel.

5. The binding device of claim 4, further comprising a cutter installed on the frame and cutting the adhesive tape so that the adhesive tape pasted on the material strip reel is separated from the tape supply unit and is left on the material strip reel.

6. The binding device of claim 5, further comprising a driving device installed on the frame and driving the first roller, the second roller, and the cutter to move synchronously and linearly in a second horizontal direction perpendicular to the first horizontal direction.

7. The binding device of claim 6, wherein the driving device includes:

a first cylinder mounted on the frame;

a first seat connected to a piston rod of the first cylinder;

a second cylinder mounted on the frame; and a second seat connected to a piston rod of the second cylinder, the first roller is rotatably mounted on the first seat, the second roller is rotatably mounted on the second seat, and the cutter is fixed to the second seat.

8. The binding device of claim 7, further comprising a first guide plate and a second guide plate installed on the frame and defining a V-shaped guide inlet to guide the material strip reel into a gap between the first roller and the second roller.

9. The binding device of claim 8, wherein the first guide plate and the first cylinder are fixedly installed on the frame, and the second guide plate and the second cylinder are movably installed on the frame.

10. The binding device of claim 9, wherein the second guide plate and the second cylinder are moved together along the first horizontal direction to adjust a spacing between the first roller and the second roller and a spacing between the first guide plate and the second guide plate at the same time to adapt to a thickness of the material strip reel.

11. The binding device of claim 10, further comprising a fixing plate fixed to the frame, the first guide plate and the first cylinder are fixed to the fixing plate.

12. The binding device of claim 10, further comprising:

a pair of sliding rods extending along the first horizontal direction and installed on the frame; and a sliding plate slidably installed on the pair of sliding rods, the second guide plate and the second cylinder are fixed to the sliding plate to slide with the sliding plate along the sliding rods.

13. The binding device of claim 12, further comprising a spacing adjustment mechanism installed on the frame and driving the sliding plate to slide along the sliding rods, to adjust the spacing between the first roller and the second roller and the spacing between the first guide plate and the second guide plate.

14. The binding device of claim 13, wherein the spacing adjustment mechanism includes a lead screw rotatably mounted on the frame and threaded with the sliding plate and a knob connected to an end of the lead screw for driving the lead screw to rotate.

15. The binding device of claim 4, wherein the first clamper is movably mounted on the frame and the second clamper is fixedly mounted on the frame, the first clamper is movable relative to the second clamper in the first horizontal direction between a first position adjacent to the second clamper and a second position distanced from the second clamper by a predetermined distance.

16. The binding device of claim 15, further comprising a slide rail installed on the frame and extending along the first horizontal direction and a slider slidably installed on the slide rail.

17. The binding device of claim 16, wherein the first clamper is fixed to the slider to move with the slider along the slide rail between the first position and the second position.

18. The binding device of claim 17, further comprising a driving mechanism mounted on the frame and driving the first clamper to move between the first position and the second position along the first horizontal direction.

19. The binding device of claim 18, wherein the driving mechanism includes a rotating cylinder and a connecting arm, one end of the connecting arm is connected to an output rotation shaft of the rotating cylinder, the other end of the connecting arm is slidably connected to the slider, the other end of the connecting arm is slidable in a second horizontal direction perpendicular to the first horizontal direction relative to the slider.

20. The binding device of claim 4, further comprising a driving device installed on the frame and driving the first roller and the second roller to move synchronously and linearly in a second horizontal direction perpendicular to the first horizontal direction.

* * * * *